US006240557B1

(12) United States Patent
Bachner, Jr.

(10) Patent No.: US 6,240,557 B1
(45) Date of Patent: Jun. 5, 2001

(54) THIN AND LIGHTWEIGHT BALLISTIC RESISTANT GARMENT

(75) Inventor: Thomas E. Bachner, Jr., Eastport, MI (US)

(73) Assignee: Second Chance Body Armor, Inc., Central Lake, MI (US)

( * ) Notice: Subject to any disclaimer, the term of this patent is extended or adjusted under 35 U.S.C. 154(b) by 0 days.

(21) Appl. No.: 09/366,029

(22) Filed: Aug. 2, 1999

Related U.S. Application Data

(63) Continuation-in-part of application No. 09/174,431, filed on Oct. 16, 1998, now Pat. No. 6,195,798.

(51) Int. Cl.[7] ..... F41H 1/02
(52) U.S. Cl. ..... 2/2.5
(58) Field of Search ..... 2/2.5; 428/911; 89/36.05, 36.01, 36.02

(56) References Cited

U.S. PATENT DOCUMENTS

| | | | | |
|---|---|---|---|---|
| 3,974,313 | | 8/1976 | James . | |
| 4,287,607 | * | 9/1981 | Leach | 2/2.5 |
| 4,608,717 | * | 9/1986 | Dunbavand | 2/2.5 |
| 4,989,266 | * | 2/1991 | Borgese et al. | 2/2.5 |
| 5,120,599 | | 6/1992 | Lewis . | |
| 5,179,244 | | 1/1993 | Zufle . | |
| 5,180,880 | | 1/1993 | Zufle . | |
| 5,185,195 | | 2/1993 | Harpell et al. . | |
| 5,196,252 | | 3/1993 | Harpell et al. . | |
| 5,198,280 | | 3/1993 | Harpell et al. . | |
| 5,233,821 | | 8/1993 | Weber, Jr. et al. . | |
| 5,343,796 | | 9/1994 | Cordova et al. . | |
| 5,373,582 | * | 12/1994 | Dragone et al. | 2/2.5 |
| 5,440,965 | | 8/1995 | Cordova et al. . | |
| 5,443,882 | | 8/1995 | Park . | |
| 5,443,883 | | 8/1995 | Park . | |
| 5,461,839 | | 10/1995 | Beck . | |
| 5,466,503 | | 11/1995 | Dischler . | |
| 5,471,906 | * | 12/1995 | Bachner, Jr. et al. | 89/36.05 |
| 5,479,659 | * | 1/1996 | Bachner, Jr. | 2/2.5 |
| 5,526,627 | | 6/1996 | Beck . | |
| 5,545,455 | | 8/1996 | Pevorsek et al. . | |
| 5,569,509 | | 10/1996 | Dischler . | |
| 5,589,254 | | 12/1996 | Dischler . | |
| 5,591,933 | * | 1/1997 | Li et al. | 89/36.02 |
| 5,619,748 | * | 4/1997 | Nelson et al. | 2/2.5 |
| 5,635,288 | | 6/1997 | Park . | |
| 5,724,670 | * | 3/1998 | Price | 2/2.5 |
| 5,773,370 | | 6/1998 | Dunbar et al. . | |
| 5,776,838 | | 7/1998 | Dellinger . | |
| 5,788,907 | | 8/1998 | Brown, Jr. et al. . | |
| 5,839,247 | | 11/1998 | Beck . | |
| 5,918,309 | * | 7/1999 | Bachner, Jr. | 2/2.5 |
| 5,958,804 | | 9/1999 | Brown, Jr. et al. . | |
| 5,965,223 | | 10/1999 | Andrews et al. . | |
| 6,026,509 | * | 2/2000 | Bachner, Jr. | 2/2.5 |
| 6,103,641 | * | 8/2000 | Gehring, Jr. | 428/911 X |
| 6,127,291 | * | 10/2000 | Coppage, Jr. et al. | 2/2.5 X |

OTHER PUBLICATIONS

Toyobo Co., Ltd., PBO Fiber Zylon New High Performace Fiber Pioneered by Toyobo, Updated, (6)™ pages, by Toyobo Co., Ltd., Osaka, Japan.

* cited by examiner

*Primary Examiner*—Rodney Lindsey
(74) *Attorney, Agent, or Firm*—Thomas J. Ring; Wildman, Harrold, Allen & Dixon

(57) ABSTRACT

A ballistic resistant protective garment with a ballistic resistant pad having at least two panels and a plurality of overlying layered sheets within the panels which are secured together by a plurality of rows of vertical panel securement stitches forming the ballistic resistant pad and in which the sheets are constructed of woven lyotropic liquid crystal polymer fiber.

92 Claims, 4 Drawing Sheets

THIN AND LIGHTWEIGHT BALLISTIC RESISTANT GARMENT

CROSS REFERENCE TO RELATED APPLICATION

The application is a continuation-in-part of U.S. patent application Ser. No. 09/174,431 entitled "Thin and Lightweight Ballistic Resistant Garment" of Bachner, Jr. filed Oct. 16, 1998 now U.S. Pat. No. 6,195,798.

FIELD OF THE INVENTION

The present invention relates to protective garments for resisting ballistic forces and more particularly to ballistic resistant pads formed of layered materials in such protective garments.

BACKGROUND OF THE INVENTION

In the evolution of protective garments, there has been an ever pressing desire to develop stronger, lighter, thinner, cooler, more breathable and thereby more wearable garments. Such garments are intended to resist certain potentially lethal forces such as those from gun shots. Typically, these garments are designed to protect the wearer from ballistic forces by preventing penetration through the garment from a projectile bullet.

Attempts at developing thin, light, heat resistant, flexible and breathable protective body armor have been made in order to create garments that are more wearable to the user. The more light, thin and less insulating the protective ballistic resistant garment is, the more likely the user (such as a law enforcement officer) will actually wear the garment, especially during the long hours of a working shift.

It is also desirable to have the protective body armor garment cover as much of the wearer's torso as possible while also maintaining wearability. The thinner and lighter the protective article, the more coverage can be offered. Concealability of the anti-ballistic body armor may also be improved if it is constructed to be thin and non-bulky. These attempts at developing thin and lightweight ballistic resistant body armor articles have also been made to try to allow increased freedom of movement and mobility so that the law enforcement officer wearing the article is not hampered from doing his or her job.

These attempts at reducing weight while improving the thinness of the article have previously been made by the utilization of layers of sheets of aramid fibers. High tensile strength aramid fibers such as Kevlar® produced by E.I. DuPont de Nemours & Company of Wilmington, Del., have often been employed in forming the woven ballistic fabric. Aramids such as Twaron® T-1000 and Twaron® T-2000 of AKZO NOBEL, Inc. have also been used in forming woven sheets of material in ballistic resistant pads. However, to increase the level of protection against higher caliber pistols and firearms more layers of ballistic resistant fabric are unfortunately required thereby increasing the overall weight and thickness of the garment while reducing its flexibility. Thus, there has been a long felt need to construct ballistic resistant pads which have improved wearability through the employment of lightweight and flexible high strength materials.

Various voluntary governmental ballistic standards have been established to certify certain ballistic resistant garments. The tests determine the ability of the garment to resist penetration from various ballistic rounds shot from various types of weapons. In particular, the National Institute of Justice (NIJ) Standard 0101.03 certification tests is a frequently used ballistics test for certifying certain body armor products. The NIJ Standard 0101.03 tests are grouped into different threat levels, with each threat level corresponding to ballistic projectile penetration stopping capabilities of various ballistic rounds fired from designated weapons. For generally concealable type ballistic resistant body armor NIJ Standard certification tests are often performed for NIJ threat levels IIA, II and IIIA. NIJ threat level IIIA is a higher standard level than NIJ threat level II and which in turn is a higher standard level than NIJ threat level IIA. Thus, there is a need to provide thin and lightweight protective body armor garments having low insulating properties to increase their wearability, while also meeting test specifications of NIJ Standard 0101.03 Threat Level IIA, II and IIIA certification tests.

SUMMARY OF THE INVENTION

The foregoing needs noted above are met in accordance with the present invention by a ballistic resistant protective garment having a ballistic resistant pad with at least two panels secured together by more than four vertical rows of panel securement stitches and a plurality of overlying layered sheets in the panels of the ballistic resistant pad in which the sheets are constructed of woven lyotropic liquid crystal polymer fiber.

It is a further object of this invention to provide a ballistic resistant protective garment having a ballistic resistant pad with a plurality of overlying layered sheets of ballistic resistant material forming the pad in which the pad has an areal density not greater than 0.49 lbs/ft$^2$, not greater than 0.60 lbs/ft$^2$, and not greater than 0.77 lbs/ft$^2$ for a ballistic resistance that prevents projectile penetration of the ballistic resistant pad according to NIJ Standard 0101.03 for Threat Levels IIA, II and IIIA respectively.

It is a further object of this invention to provide a ballistic resistant protective garment which includes a ballistic resistant pad and a plurality of overlying layered sheets of ballistic resistant material forming the pad in which the pad has a thickness not greater than 0.13 inches, not greater than 0.16 inches and not greater than 0.20 inches for a ballistic resistance that prevents projectile penetration of the ballistic resistant pad according to NIJ Standard 0101.03 for Threat Levels IIA, II and IIIA respectively.

BRIEF DESCRIPTION OF THE DRAWING

The foregoing objects and advantageous features of the invention will be explained in greater detail and others will be made apparent from the detailed description of the various embodiments of the present invention which are given with reference to the several figures of the drawing, in which.

DETAILED DESCRIPTION

Figure 1:
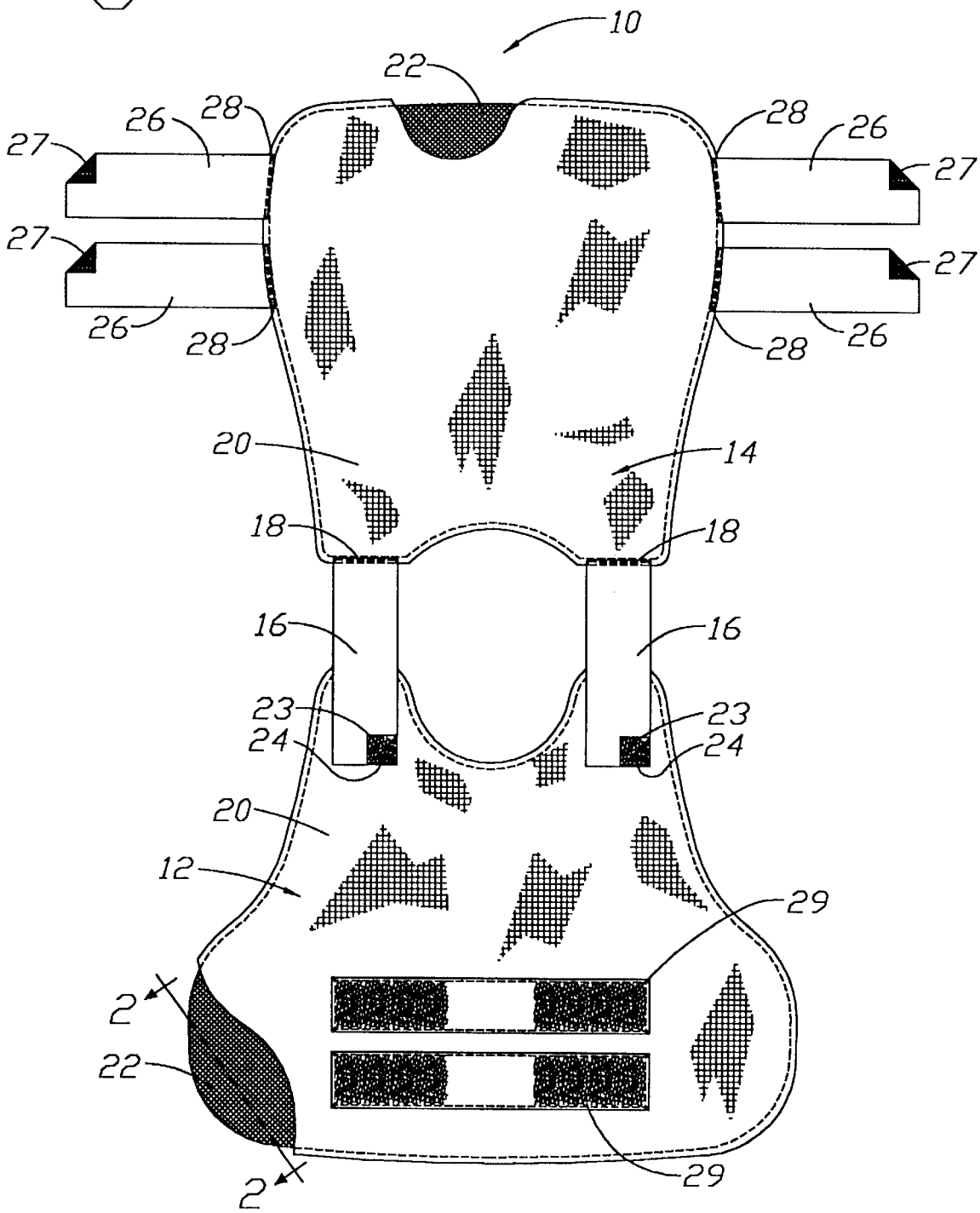
FIG. 1 is an a plan view of a ballistic resistant garment of the present invention partially broken away to illustrate a pad cover underlying an outer carrier.

Referring now to FIG. 1, ballistic resistant protective garment 10 for covering and protecting vital portions of a person's body supporting the garment is shown. The thin and lightweight protective ballistic resistant garment 10 of FIG. 1 has a front garment section 12 for generally covering the front region of a wearer and a back garment section 14 for generally covering a back region of the wearer. Adjustably connecting the front section 12 and back section 14 are shoulder straps 16. The ends 18 of shoulder straps 16 are preferably secured (by stitching or other suitable means) to an outer cloth carrier 20 of the back section 14 of the garment. Carrier 20 carries a ballistic resistant pad 30 (in both the front and back garment sections) which is discussed in more detail below. The ballistic resistant pad is removable from carrier 20 for replacement when desired. The outer carrier 20 encloses and carries the pad and pad cover 22 and supports the covered pad against the body of the wearer.

Additionally, each ballistic resistant pad 30 is covered and enclosed within pad cover 22 which is preferably constructed of water resistant and vapor permeable material such as GORE-TEX®, as shown in the break away views of FIG. 1. As seen in FIG. 1, opposing ends 23 of the shoulder straps 16 are shown having releasably securable hook and loop fasteners or VELCRO® which engage corresponding mating fastener pad members 24 placed at a shoulder region of the outer carrier 20 of the front garment section 12. The shoulder straps 16 are adjustable to move the front 12 and back 14 sections to a desired position over the torso region of the body of the wearer.

In use, the front section 12 and back section 14 of the garment may also be suitably secured at their side regions by side straps 26. The side straps 26 are secured at one end 28 by stitching or other suitable means to the outer carrier 20 of the back section 14. The opposing ends 27 of the side straps 26 preferably have VELCRO® type hook and loop fasteners which are placed upon the outer cloth carrier at the front section 12 of the garment. The side straps 26 are pulled about the torso of the wearer and the free ends 27 are overlaid and engage mating pads 29 to comfortably fit the garment 10 about the body of the wearer.

Figure 2:
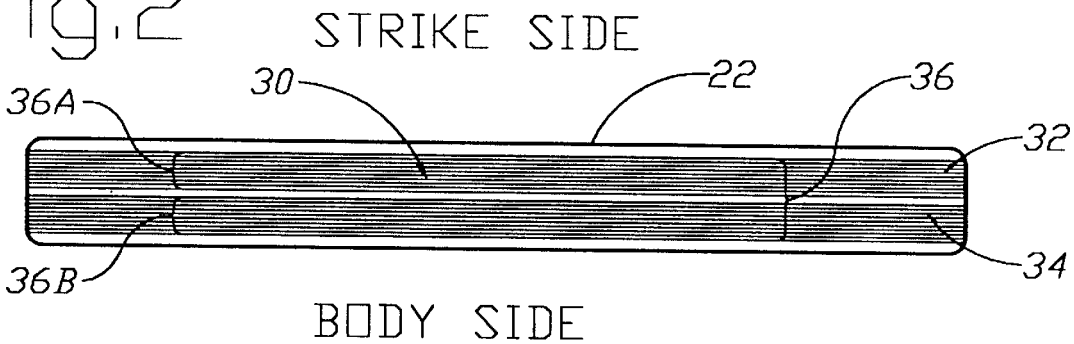
FIG. 2 is a cross sectional view taken along line 2—2 of FIG. 1 (stitches through panels not shown)

Referring now to FIG. 2, ballistic resistant pad 30 is shown being encased by pad cover 22. The outer pad cover 22 covers and encloses the ballistic resistant pad 30 and preferably is substantially the same shape as the pad to provide a snug enclosure fit about the pad. The pad cover 22 preferably is constructed at least in part of water proof moisture permeable material such as GORE-TEX® COMFORTCOOL® fabric manufactured by W. L. Gore & Associates, Inc. of Newark, Del. or other suitable material such as dynamic water repellent (DWR) treated material made from Supplex® a nylon fiber manufactured by E. I. DuPont de Nemours & Co. of Wilmington, Del. The pad cover 22 encasing the protective pad 30 primarily serves to prevent the inner pad from being exposed to environmental conditions or bodily fluids such as water, oil, sweat, body oils, chemical and fuel spills and the like.

As seen in FIG. 2, the ballistic resistant pad 30 preferably has at least two panels 32, 34. For simplicity, FIG. 2 is shown without the layer securement stitches and the radial multi-panel securement stitches which are shown and described with reference to FIGS. 3A–3C. A first panel 32 is positioned at a strike side portion of the pad 30 and a second panel 34 is positioned at a body side portion of the pad. The strike side panel 32 and body side panel 34 are positioned adjacent to one another in an overlying relationship. Each panel 32, 34 of the pad 30 is formed of a plurality of overlying layered sheets 36 of woven high strength penetration resistant material. Each sheet 36 of the ballistic resistant pad 30 have substantially the same length and width dimensions and are substantially the same thickness. The panels 32, 34 each a have a plurality of at least two overlying and adjacent layered sheets 36. The strike side panel 32 preferably has nine plies of woven overlying sheets 36A and the body side panel 34 also has nine plies of woven overlying sheets 36B for a pad 30 having a ballistic resistance that prevents projectile penetration according to NIJ Standard 0101.03 for Threat Level IIA as discussed in greater detail in FIG. 3A. The plurality of adjacent and overlying layered sheets 36 in the first strike side panel 32 and second body side panel 34 of the pad 30 are constructed of woven lyotropic liquid crystal polymer fiber. Preferably, each of the panels 32, 34 of the pad 30 have an equal number of sheets 36 of woven lyotropic liquid crystal polymer fiber material.

Figure 4:
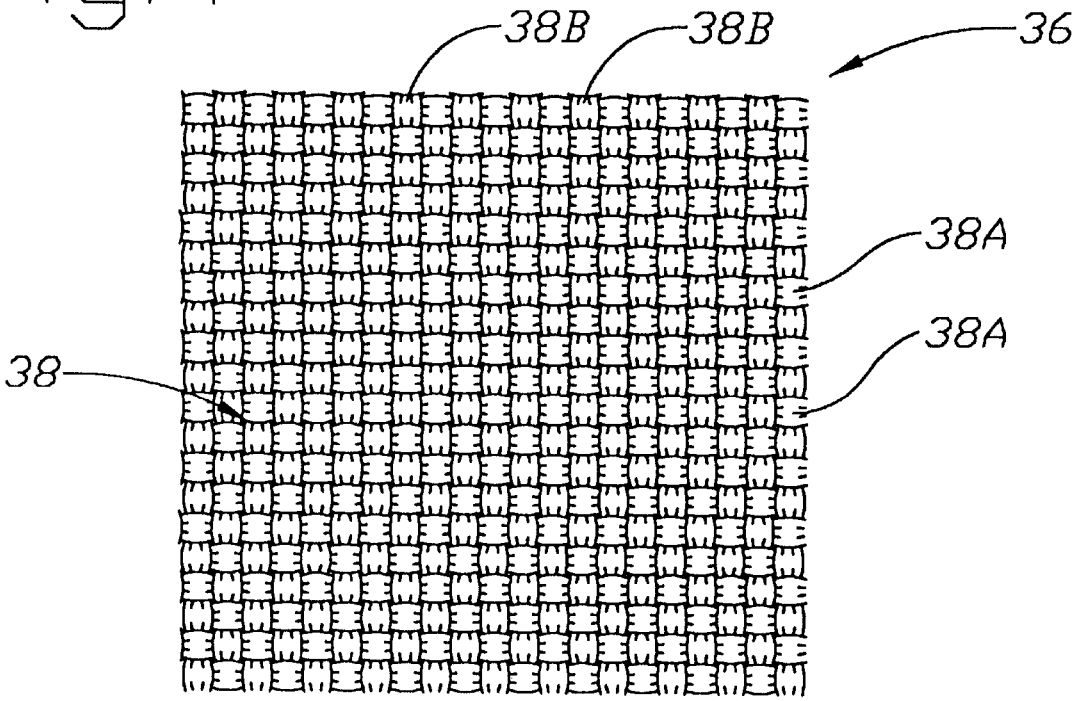
FIG. 4 is an enlarged partial view representative of the weave of a sheet of woven lyotropic liquid crystal polymer fibers of the present invention.

Referring ahead now to FIG. 4, an enlarged partial view representative of the weave of a sheet 36 of woven lyotropic liquid polymer fibers 38 is shown. The individual plies or sheets 36 of the pad 30, FIG. 2, are preferably formed by a balanced weave of fibers 38. The weave for the sheets 36 constructed of the lyotropic liquid crystal polymer fibers 38 has a warp to fill ratio of 30 by 30 fibers per inch. There are thirty horizontal warp fibers 38A and thirty vertical fill fibers 38B per inch for a sheet 36 of woven lyotropic liquid crystal polymer fiber 38. Alternatively, the weave may selectively be balanced having 28×28 or a 26×26 fibers per inch weave. Additionally, an imbalanced weave of PBO fibers 38 may suitably be employed with the weave preferably having two fewer fill ends than the warp ends per inch such as a 26×24 warp to fill ratio per inch, a 30×28 ratio or a 28×26 ratio. However, any suitable imbalanced weave of PBO fibers may selectively be employed.

Each of the woven overlying sheets 36, FIG. 4, are preferably constructed of a rigid-rod lyotropic liquid crystal polymer fiber formed from poly(p-phenylene-2,6-benzobisoxazole) (PBO) developed by Toyobo Co. Ltd. of Osaka, Japan and sold under the trademark ZYLON®. The high strength and heat resistant poly(p-phenylene-2,6-benzobisoxazole) (PBO) fiber woven into the sheets 38 and incorporated into the individual ballistic resistant panels 32, 34 further enable the pad 30 to provide high penetration resistance while being thin, lightweight, flexible and cool thereby enhancing the wearability of the garment. The lyotropic liquid crystal polymer fiber material 38, FIG. 4, has a filament denier of 1.5 dpf (denier per filament) and a density ranging from 1.54 to 1.56 g/cm$^3$. Denier is grams per 9000 meters (g/9000 meters). The PBO fiber 38 preferably employed has a tensile strength at 42 grams/denier and 840 KSI (one thousand pounds per square inch). Additionally, the preferred PBO fiber 38 has a tensile modulus ranging from 1300 to 2000 grams/denier and a decomposition temperature in air of 650 degrees centigrade. The elongation at break for the lyotropic liquid crystal polymer fiber 38 ranges from 2.5 percent to 3.5 percent.

Figure 3A:
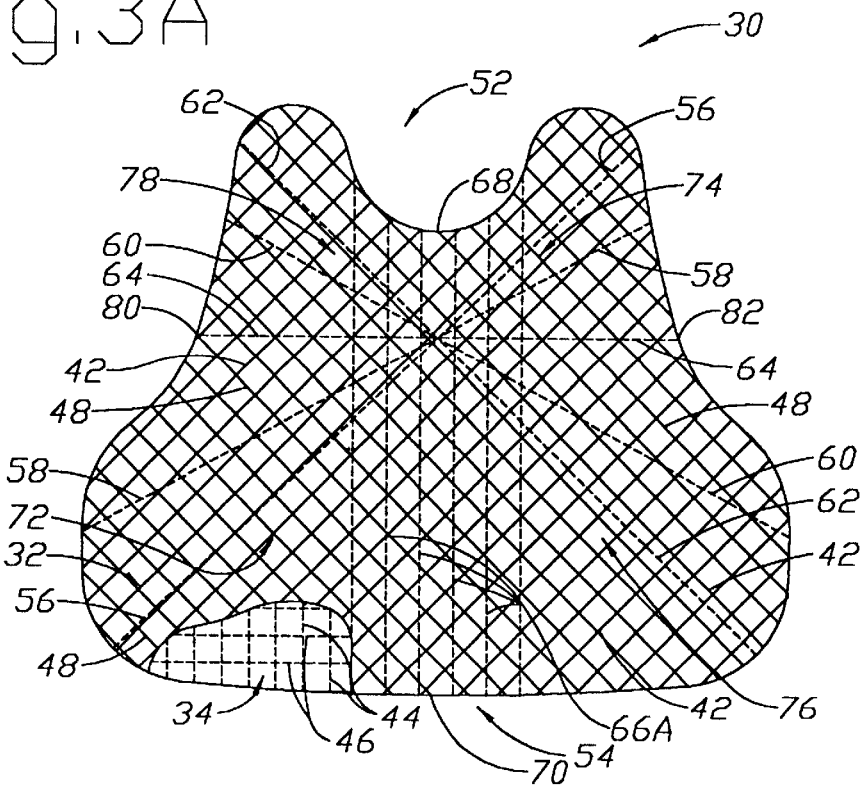
FIG. 3A is a plan view of one embodiment of the ballistic resistant pad of the present invention.
Figure 3B:
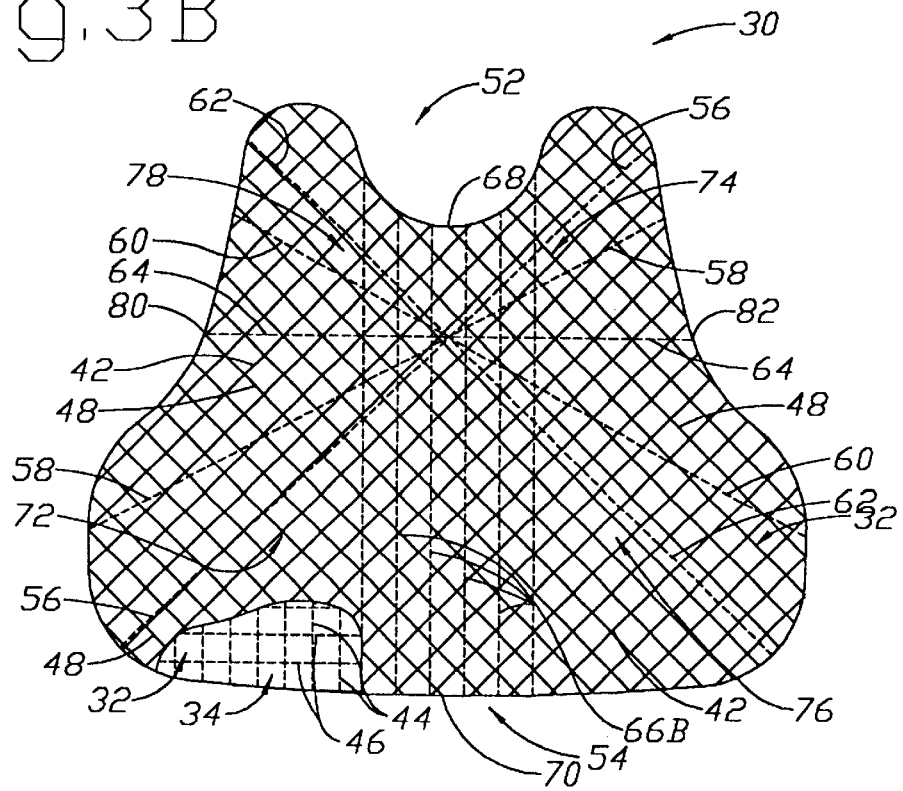
FIG. 3B is a plan view of another embodiment of the ballistic resistant pad of the present invention.
Figure 3C:
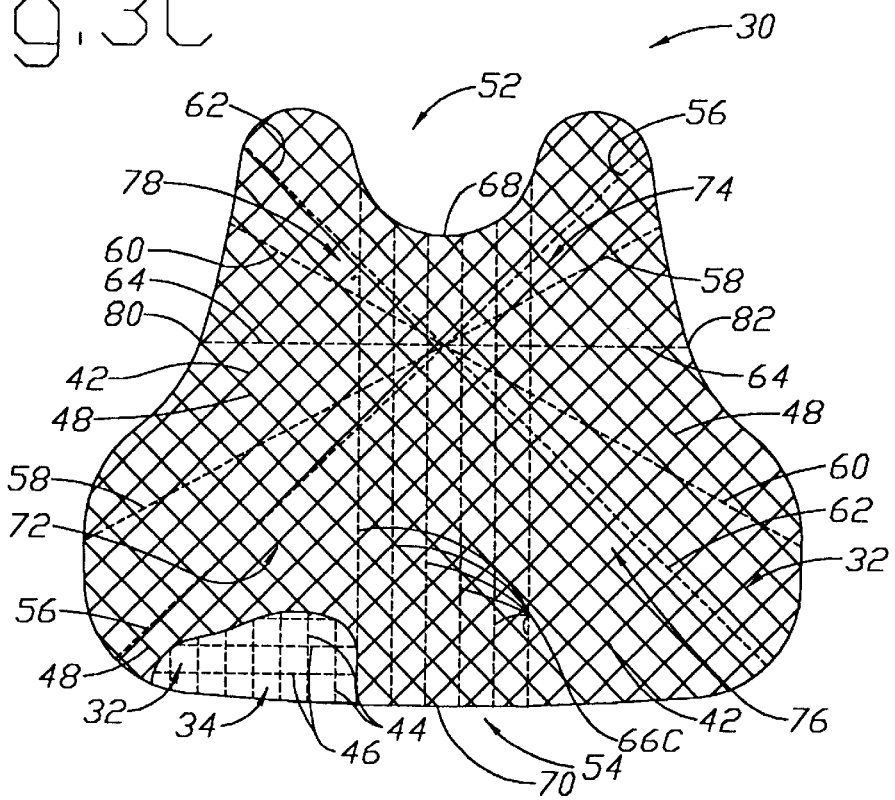
FIG. 3C is a plan view of a third embodiment of the ballistic resistant pad of the present invention.

Referring now to FIGS. 3A–3C, ballistic resistant pad 30 of the ballistic resistant protective garment is shown having the strike face panel 32 and the underlying body side panel 34. The underlying body side panel 34 to be worn against the body (preferably at a torso region) of the wearer. In FIGS. 3A–3C, the panel 30 of the front garment section 12 is shown and described below. However, it is appreciated that a panel for the back garment section (not shown) of the various embodiments has the same properties and structural features as the front panels described herein. The pad 30 in the embodiment shown in FIG. 3A has a ballistic resistance that prevents projectile penetration for the pad according to National Institute of Justice (NIJ) Standard 0101.03 for Threat Level IIA and preferably has nine overlying sheets 36A for the strike side panel 32 and nine overlying sheets 36B for the body side panel 34. In accordance with the present invention the pad 30 in the embodiment of FIG. 3A has a thickness of 0.13 inches and an areal density of 0.49 lbs/ft$^2$. The Threat Level IIA ballistic resistant pad 30 seen in FIG. 3A will stop ballistic penetration from the Winchester 9 mm 127 g SXT and the 250 g 0.44 magnum Black Talon while achieving optimum comfort, wearability and performance.

Referring to FIG. 3B, the ballistic resistant panel 30 in this embodiment has eleven overlying sheets 36A of woven lyotropic liquid crystal polymer fiber material for the strike side panel 32 and eleven overlying woven sheets 36B of the fiber material for the body side panel 34. In accordance with the present invention, the pad 30 in the embodiment of FIG. 3B has a thickness of 0.16 inches and an areal density of 0.60 lbs/ft$^2$ while maintaining a ballistic resistance that prevents projectile penetration of the pad 30 according to NIJ Standard 0101.03 for Threat Level II.

In the embodiment of FIG. 3C, the ballistic resistant pad 30 preferably has fourteen overlying sheets 36A of woven PBO fiber material for the strike side panel 32 and fourteen overlying woven sheets 36B of the PBO fiber 38 for the body side panel 34. In accordance with the present invention, the pad 30 in the embodiment in FIG. 3C has a thickness of 0.20 inches and an areal density of 0.77 lbs/ft$^2$ while maintaining a ballistic resistance that prevents projectile penetration of the pad according to NIJ Standard 0101.03 for Threat Level IIIA.

Referring generally to FIGS. 3A–3C, each of the embodiments shown has a pad 30 with a strike side panel 32 and a body side panel 34 and having a plurality of overlying layered sheets 36, FIG. 2, of woven PBO fibers 38, FIG. 4. As seen in FIGS. 3A–3C, a purality of sheet securement stitches 42 are disposed into the strike side panel 32 connecting the plurality of sheets 36A together within the strike side panel. At least one row, and preferably a plurality of rows of sheet securement stitches 42 are aligned in a first direction at the first panel 32. The rows of layer securement stitches 42 in the first direction are disposed only in the strike side panel 32 and are employed to connect together the woven sheets 36A to form the strike side panel.

Another plurality of sheet securement stitches 44, 46 which are disposed only in the second underlying body side panel 34 likewise only connect the woven sheets 36B of the body side panel 34. These other sheet securement stitches are positioned in a plurality bf at least two rows 44, 46 in which the plurality of securement stitching rows 44, 46 are aligned in a second (generally vertical) and a third (generally horizontal) direction respectively, as seen in FIGS. 3A–3C. The second and third directions of the rows of sheet securement stitches 44 and 46 are transverse to one another and are preferably perpendicular to one another. Additionally, row 42 of stitching in the first direction across the strike side panel 32 is transverse to the two other rows of stitches 44, 46 positioned in the aforementioned second and third directions across the second or body side panel 34.

The rows of stitches 42 in the strike side panel 32 and the rows of stitches 44, 46 of the body side panel are both composed of high strength penetration resistant fibers, for instance aramid fibers such as Kevlar® developed by E.I. DuPont de Nemours & Company of Wilmington, Del. Other high strength penetration resistant fibers providing improvements may suitably be found through the employment of Spectra® fiber made by Allied Signal & Co. of Morris County, N.J., or a rigid-rod lyotropic liquid crystal polymer fiber formed from poly(p-phenylene-2,6-benzobisoxazole) (PBO) developed by Toyobo Co. Ltd. of Osaka, Japan and sold under the trademark ZYLON®.

As seen in FIGS. 3A–3C, the plurality of stitching rows 42 securing the sheets 36A of strike side panel 32 are spaced apart and are substantially parallel to one another in the first direction. Also seen in FIGS. 3A–3C the strike side panel 32 further includes a plurality of other crossing rows of sheet securement stitches 48 spaced apart from one another and substantially parallel to one another in which the rows 42 of stitches in the first direction and the plurality of other rows 48 securing the sheets 36A of ballistic resistant material are transverse to one another and in this embodiment substantially perpendicular to one another. Moreover, the rows of sheet securement stitches 42, 48 of first (strike side) panel 32 each extend substantially across first panel 32. The rows of sheet securement stitches 42, 48 of first strike side panel 32 form a pattern of quilt stitches in the strike side panel 32.

In referring to the second underlying body side panel 34, as seen in FIGS. 3A–3C, the rows of sheet securement stitches 44 are spaced apart from one another, are substantially parallel to one another and are positioned in a second direction or generally vertical direction. The underlying body side panel 34 further has another plurality of rows of sheet securement stitches 46 spaced apart from one another which are substantially parallel to one another and are positioned in a third direction or generally horizontal direction in these embodiments. The generally vertical rows of stitches 44 and the generally horizontal rows of stitches 46 are preferably positioned substantially perpendicular to one another, as seen in FIGS. 3A–3C. Rows of stitches 44, 46 of the second body side panel 34 each extend substantially across the panel 34. As a result, in these embodiments the plurality of the rows of stitches 44, 46 of body side panel 34 form a pattern of box stitches.

These plurality of rows of sheet securement stitches 42, 48 and 44, 46 are all composed of a high tensile strength fiber such as an aramid or such other suitable material. Preferably, aramids are employed as the stitching material to hold together the ballistic resistant woven layered sheets 36A, 36B. The plurality of rows of sheet securement stitches extend entirely through each of sheet layers of woven PBO material which results in the forming of the individual panels. The sheet securement stitches 42, 48 are completely disposed through each of the ballistic resistant sheets 36A to form and establish strike side panel 32. In similar fashion, the underlying body side panel 34 is formed by the box stitching pattern of sheet securement stitches 44, 46 which only connect the ballistic resistant sheets 36B of panel 34 together. Individual panels may alternatively be formed by other suitable securement approaches such as stitching about the periphery of ballistic resistant sheets, bar tacs, non-invasive securement of the layered sheets and the like.

As shown in FIGS. 3A–3C, first panel 32 may selectively contain a pattern of quilt stitches 42, 48 positioned substantially across strike side panel 32 and panel 34 may selectively contain a pattern of box stitches 44, 46 positioned substantially across panel 34. As discussed in more detail in U.S. Pat. No. 5,479,659 entitled "Lightweight Ballistic Resistant Garments And Method To Produce The Same" issued Jan. 2, 1996 to Bachner, Jr. assigned to the assignee of the present invention and which is hereby incorporated by reference herein, these stitching patterns in the different panels 32, 34 which overlie and are adjacent to one another provide transference of energy at time of impact by a bullet or other projectile force.

As also seen in FIGS. 3A–3C, the ballistic resistant pad 30 of the present invention includes a plurality of radial stitches 56, 58, 60, 62, 64 which extend entirely through the ballistic resistant panels 32, 34 securing them together. The radial stitches 56, 58, 60, 62, 64 seen in the embodiments of FIGS. 3A–3C advantageously provide improved laboratory performance against multiple impacts striking at various angles and at different regions of the garment without detracting from wearability. Similarly, as discussed above for stitches 42, these radial stitches are composed of high strength penetration resistant fibers such as aramid fibers such as Kevlar® developed by E.I. DuPont de Nemours & Company of Wilmington, Del. Other high strength penetration resistant fibers providing improvements may suitably be found through the employment of Spectra® fiber made by Allied Signal & Co. of Morris County, N.J., or a rigid-rod lyotropic liquid crystal polymer fiber formed from poly(p-phenylene-2, 6-benzobisoxazole) (PBO) developed by Toyobo Co. Ltd. of Osaka, Japan and sold under the trademark ZYLON®.

The ballistic resistant pad 30, FIGS. 3A–3C, is shown having a top end 52 (proximate a neck and shoulder area of a wearer) and a bottom end 54 (proximate a waist area of a wearer), with multiple panels 32, 34 each preferably constructed of a plurality of layered sheets of woven PBO material. A multiplicity of stitches are disposed in a row for each row of multi-panel radial securement stitches 56, 58, 60, 62, 64 which are sewn entirely through the ballistic resistant panels 32, 34 in order to secure the panels together. The rows of radial stitching 56, 58, 60, 62, 64, FIGS. 3A–3C, sewn through the ballistic resistant pad 30 securing panels 32 and 34 together, are each positioned in a direction angularly displaced from a substantially vertical direction determined between the top end 52 and the bottom end 54 of the pad.

Additionally, as also seen in FIGS. 3A–3C a plurality of vertical rows of panel securement stitches 66A, 66B, 66C are also disposed and secured entirely through the ballistic resistant panels 32, 34. FIGS. 3A, 3B and 3C have six vertical rows of stitches 66A, 66B secured through the panels 32, 34 and connecting them together for the pads having ballistic resistance meeting NIJ Threat Level IIA, II and IIIA standards respectively. Preferably, more than four vertical rows of panel securement stitches are employed to connect the panels together forming pad 30. The stitching rows 66A–C continuously extend in a substantially vertical direction between the top edge 68 and bottom edge 70 of the ballistic resistant panels 32, 34. It has been found that providing the six vertical rows of stitches 66A–66C, to secure the strike side and body side panels 32, 34 together, further aids in the distribution of energy across the pad 30 upon a ballistic impact. The vertical rows of stitches 66A–66C are positioned at a central region, spaced apart from a right edge 82 and a left edge 80, of the pad 30 proximate a sternum area of a wearer upon the garment being worn. Advantageously, the vertical rows of stitches 66A–66C reduces potential shifting and separation movement of the ballistic resistant sheets in the panels 32, 34, especially upon receipt of multiple ballistic impacts as seen in a body armor testing laboratory environment.

The six rows of vertical panel securement stitches 66A–66C substantially extend from the top end 52 to the bottom end 54 of the pad 30 securing each of the overlying layered sheets 36 and both panels 32, 34 together. Adjacent ones of the vertical panel securement stitches are aligned substantially parallel to one another and are spaced at least one inch, and preferably one and a quarter (1.25) inches from each other. The strike side panel 32 and the body side panel 34 both have the same number of overlying sheets 36 in the embodiments described in FIGS. 3A–3C. The vertical panel securement stitches 66A–66C are stitched through each of the sheets 36 in both panels 32, 34. The vertical panel securement stitches are preferably constructed of high strength penetration resistant fibers such as aramid fiber.

The rows 56, 58, 60, 62, 64 of radial stitching preferably substantially extend across the width from one edge to an opposing edge of the panels 32, 34. Moreover, the multi-panel securement stitches may selectively include a number of pattern configurations which include at least one of the first through fifth rows of stitches described hereinbelow. A first row of radial stitches 56 continuously extends in substantially a straight line from an edge of a lower left portion 72 of the pad 30 including panels 32, 34 and extends diagonally across the pad to an opposing edge of an upper right portion 74 of the pad. A second row of radial multi-panel securement stitches 62 continuously extends from and edge of a lower right portion 76 of the panels 32, 34 diagonally across the pad 30 to an upper left portion 78 of the pad. A third row of multipanel securement stitches 64 continuously extends horizontally from left edge 80 of the panels 32, 34 across the pad 30 to an opposing right edge 82 of the pad.

As further seen in the embodiments of FIGS. 3A–3C, a fourth row of radial stitches 58 continuously extends substantially in a straight line from an edge of the lower left portion 72 of the pad 30 to an opposing edge generally in the upper right portion 74 of the pad. The intermediate fourth row of radial stitches 58 at the edge of the lower left portion 72 is positioned approximately halfway between the horizontally extending third row of stitches 64 and the first row of stitches 56. Additionally, the intermediate fourth row of radial multi-panel securement stitches 58 continuously extends to an opposing edge in the upper right portion 74 of the panels 32, 34 where stitches 58 are positioned approximately half way between the horizontally extending third row of multi-panel securement stitches 64 and the first row of multi-panel securement stitches 56 that extend from the lower left portion-of the pad to the upper right portion. FIGS. 3A–3C also illustrate an intermediate fifth row of multi-panel securement stitches 60 which at the edge of the ballistic resistant pad 30, is positioned generally half way between the horizontally extending third row of stitches 64 and the diagonally extending second row of stitches 62. The fifth row of radial multi-panel securement stitches 60 substantially continuously extends from and edge of the lower right portion 76 of the pad 30 and is positioned between the third row of stitches 64 and the second row of stitches 62. The intermediate fifth row of stitches 60 extends to an opposing edge of the pad 30 positioned approximately half way between the third row of stitches 64 and the second row of stitches 62 in the upper left portion 78 of the pad 30. Rows of radial multi-panel securement stitches 58, 60 generally pass through the central or sternum area of panels 32, 34 as seen in FIGS. 3A–3C.

The extended rows of radial stitches 56, 58, 60 and 62 are preferably positioned, with respect to the wearer, in the lower left portion, lower right portion, upper left portion and upper right portion of the panels forming the ballistic resistant pad. The edge to edge rows of radial stitches 56, 58, 60, 62, 64 sewn through and across the ballistic resistant panels 32, 34 reduces shifting and binding movement of the ballistic resistant sheets, especially upon receipt of multiple ballistic impacts as seen in a body armor testing laboratory environment.

As seen in FIGS. 3A–3C, row of stitches 56 continuously extends in substantially a straight line from edge to edge across the panels 32, 34 on the front garment section 12 from the lower left portion 72 to the upper right portion 74 of the panels. The row of stitches 56 across panels 32, 34 on the front garment section 72 pass over a sternum area of the wearer upon the panels being worn over the front torso of the wearer. Similarly, row of stitches 62 continuously extending from the lower right portion 76 to the upper left portion 78 of the panels 32, 34 of the ballistic resistant pad 30 also pass over the sternum area of the wearer upon the panels being worn over a front torso.

As seen in FIGS. 3A–3C, row of stitches 56 continuously extends in substantially a straight line from edge to edge across the panels 32, 34 on the front garment section 12 from the lower left portion 72 to the upper right portion 74 of the panels. The row of stitches 56 across panels 32, 34 on the front garment section 72 pass over a sternum area of the wearer upon the panels being worn over the front torso of the wearer. Similarly, row of stitches 62 continuously extending from the lower right portion 76 to the upper left portion 78 of the panels 32, 34 of the ballistic resistant pad 30 also pass over the sternum area of the wearer upon the panels being worn over a front torso.

As seen in FIGS. 3A–3C, row 64 of radial multi-panel securement stitches is positioned in a horizontal direction determined generally between the right edge 82 and left edge 80 of the pad 30 and row 64 further horizontally extends completely across the pad from the right edge to the left edge. As seen in FIGS. 3A–3C, horizontal row of stitches 64, continuously extending in substantially a straight line across the width of the panels 32, 34, also passes over the sternum area of the wearer with the panels being positioned over the front of the wearer's torso.

Referring again to FIG. 3A, the ballistic resistant pad 30 having a ballistic resistance that prevents projectile penetration of the pad 30 according to National Institute of Justice (NIJ) Standard 0101.03 for Threat Level IIA is shown. Resistance to projectile penetration that meets NIJ Standard 0101.03 certification testing for Threat Level IIA involves a 0.357 Magnum, 158 grain JSP projectile at 1,250 feet per second (fps) and a 9 mm, 124 grain FMJ RN projectile at 1090 fps.

The preferred method of making the ballistic resistant pad 30 of FIG. 3A involves weaving eighteen individual plies or sheets 36 of PBO fiber in a balanced 30×30 warp to fill per inch plain weave having 99,800,100 filament crossovers per square inch and 900 fiber crossovers per square inch. The eighteen woven sheets 36 are divided into two panels 32, 34. The front nine strike face sheets 36A are sewn together using Kevlar® aramid fiber sewing thread at four stitches per inch. A 1.25 inch quilt stitch pattern is sewn through the nine strike face sheets 36A of panel 32. The nine back body side sheets 36B are also sewn together using Kevlar® sewing thread at four stitches per inch and a 1.25 box stitch pattern is sewn through the nine body side sheets 36B of panel 34.

The quilt stitched plies 36A of panel 32 are placed on the box stitched plies 36B of panel 34 and the pad 30 is sewn together (using Kevlar® sewing thread) front through back with six vertical seams 66A centered on the pad at 1.25 inches apart. The step of sewing a radial stitching "X" pattern from each bottom corner to each top shoulder corner is performed by inserting radial stitches 56, 62 through the pad 30. The intersection of the "X" pattern is proximate to the sternum area of the wearer of the protective garment. The step of sewing a horizontal row of radial stitches 64 across and through the pad 30 at the "X" intersection of radial stitches 56, 62 is then performed. Next the step of sewing a diagonal row of radial stitches 58, 60 from center of the "X" to each armpit area of the vest half way between the horizontal stitches 64 and the upper radial stitches 56, 62 and also sewing radial stitches 58,60 from the center of the "X" to each lower side of the pad 30 half way between horizontal stitches and the lower "X" line of radial stitches 56, 62 is performed. The step of placing the pad 30 into the pad cover 22 is then performed and the pad cover is closed with a seam below the bottom of the pad. Preferably, the sheets 36 are scoured only and no water repellent finish (F-101) is employed on the sheets 36 of ballistic resistant material. Alternatively, water repellent finish on the woven sheets may be selectively applied.

Referring again to FIG. 3B, the ballistic resistant pad 30 having a ballistic resistance that prevents projectile penetration of the pad 30 according to NIJ Standard 0101.03 for Threat Level II is shown. Resistance to projectile penetration that meets NIJ Standard 0101.03 Certification Testing for Threat Level II involves a 0.357 Magnum, 158 grain JSP projectile at 1,395 feet per second (fps) and a 9 mm, 124 grain FMJ projectile at 1175 fps. The preferred steps of making the ballistic resistant pad 30 of FIG. 3B providing projectile penetration resistance at Threat Level II are the same as those set forth above for Threat Level IIA described in FIG. 3A except twenty-two (22) sheet plies of the same woven PBO fiber material are employed with eleven (11) sheets utilized in each panel 32, 34.

Referring again to FIG. 3C, the ballistic resistant pad 30 having a ballistic resistance that prevents projectile penetration of the pad 30 according to NIJ Standard 0101.03 for Threat Level IIIA is shown. Resistance to projectile penetration that meets NIJ Standard 0101.03 Certification Testing for Threat Level IIIA involves a 0.44 Magnum, 240 grain SWC projectile at 1400 feet per second (fps) and a 9 mm, 124 grain FMJ projectile at 1400 fps. The preferred steps of making the ballistic resistant pad 30 of FIG. 3C providing the projectile penetration resistance at Threat Level IIIA is substantially the same as the method steps set forth above for the Threat Level IIA pad described in FIG. 3A. The method of forming the pad 30 of FIG. 3C includes the step of providing twenty-eight (28) sheet plies 36 of the woven PBO material and dividing them into sets of fourteen sheets 36A, 36B for each panel 32, 34. Finally, the step of sewing six vertical seams of Kevlar® stitching 66C through the entire pad 30 is also performed in forming the pad in the embodiment of FIG. 3C for Threat Level IIIA.

While a detailed description of the preferred embodiment of the invention has been given, it should be appreciated that many variations can be made thereto without departing from the scope of the invention as set forth in the appended claims.

What is claimed is:

1. A ballistic resistant protective garment for positioning upon a body of a wearer in which the garment has a ballistic resistant pad having a top end for positioning proximate a neck area of the wearer and a bottom end for positioning proximate a waist area of the wearer, comprising:

at least two panels within the ballistic resistant pad;

a plurality of overlying layered sheets in the at least two panels of the ballistic resistant pad and in which the sheets are constructed of woven lyotropic liquid crystal polymer fiber; and a plurality of more than four rows of vertical panel securement stitches substantially extending from the top end to the bottom end of the pad securing the at least two panels of the pad together.

2. The ballistic resistant protective garment of claim 1 in which the ballistic resistant pad has at least six rows of said vertical panel securement stitches.

3. The ballistic resistant protective garment of claim 2 in which adjacent ones of the rows of vertical panel securement stitches are spaced at least one inch apart from each other.

4. The ballistic resistant protective garment of claim 2 in which adjacent ones of the rows of vertical panel securement stitches are spaced approximately one and a quarter (1.25) inches apart from each other.

5. The ballistic resistant protective garment of claim 2 in which the at least two panels of the pad include a first panel and a second panel in which both the first panel and second panel have the same number of overlying layered sheets.

6. The ballistic resistant protective garment of claim 5 in which the rows of vertical panel securement stitches are stitched through each of the overlying layered sheets in both the first panel and the second panel of the pad.

7. The ballistic resistant protective garment of claim 6 in which the vertical panel securement stitches are constructed of high strength penetration resistant fibers.

8. The ballistic resistant protective garment of claim 7 in which the vertical panel securement stitches are constructed of aramid fiber.

9. The ballistic resistant protective garment of claim 2 in which the rows of vertical panel securement stitches are positioned at a central region of the pad, spaced apart from a right edge and a left edge of the pad, proximate a sternum area of the wearer with the pad positioned over the front of a torso of the wearer.

10. The ballistic resistant protective garment of claim 2 in which the sheets are constructed of a rigid-rod lyotropic liquid crystal polymer fiber.

11. The ballistic resistant protective garment of claim 10 in which the rigid-rod lyotropic liquid crystal polymer fiber is formed from poly(p-phenylene-2,6-benzobisoxazole).

12. The ballistic resistant protective garment of claim 2 in which the at least two panels of the pad include a first panel and a second panel each having a plurality of at least two of said overlying layered sheets, a plurality of stitches disposed into the first panel connecting the plurality of sheets together within the first panel in which the plurality of stitches includes at least one row of stitches aligned in a first direction, and another plurality of stitches are disposed into the second panel connecting the plurality of sheets together within the second panel in which the other plurality of stitches includes at least two rows of stitches aligned in second and third directions transverse to one another and in which the row of stitches in the first panel aligned in the first direction is transverse to the rows in the second and third directions in the second panel.

13. The ballistic resistant protective garment of claim 12 in which the plurality of stitches are disposed in the first panel only and in which the other plurality of stitches are disposed in the second panel only.

14. The ballistic resistant protective garment of claim 12 in which the plurality of stitches disposed in the first panel includes a plurality of rows of stitches substantially parallel to one another and spaced apart from one another and are substantially aligned in the first direction and in which the plurality of stitches has another plurality of rows of stitches substantially parallel to one another and spaced apart from one another in which the other plurality of rows of stitches are positioned transverse to the plurality of rows of stitches in the first direction, and the other plurality of stitches disposed in the second panel includes a plurality of rows of stitches substantially parallel to one another and spaced apart from one another and aligned substantially in the second direction and in which the other plurality of stitches includes another plurality of rows of stitches substantially parallel to one another and spaced apart and aligned substantially in the third direction.

15. The ballistic resistant protective garment of claim 14 in which the rows of stitches and the other rows of stitches in the first panel are substantially perpendicular, and in which the plurality of rows and the other plurality of rows of stitches of the second panel are substantially perpendicular.

16. The ballistic resistant protective garment of claim 15 in which the plurality of rows of stitches and the other plurality of rows of stitches of the first panel form a pattern of quilt stitches in the first panel, and in which the plurality of rows and the other plurality of rows of stitches of the second panel form a pattern of box stitches in the second panel.

17. The ballistic resistant protective garment of claim 2 including at least one row of radial stitches positioned through a first panel and a second panel of the pad and connecting the first panel and second panel together.

18. The ballistic resistant protective garment of claim 17 in which the at least one row of radial stitches is positioned in a direction angularly displaced from a substantially vertical direction determined generally between the top and bottom ends of the pad.

19. The ballistic resistant protective garment of claim 18 in which the at least one row of radial stitches includes a first row of radial stitches which extends from proximate an edge of a lower left portion of the pad and extends diagonally across the pad over the sternum area of a wearer, with the pad positioned over the front of a torso, to an opposing edge of an upper right portion of the pad, a second row of radial stitches which extends from proximate an edge of a lower right portion of the pad and extends diagonally across the pad over the sternum area of the wearer to an opposing edge on upper left portion of the pad, and a third row of radial stitches which extends horizontally from a left edge of the pad across the pad and over a sternum area of the wearer to an opposing edge on the right edge of the pad.

20. The ballistic resistant protective garment of claim 19 including a fourth row of radial stitches which extends from an edge of the lowest left portion of the pad positioned between the third row of stitches and the first row of stitches and in which the fourth row extends to an opposing edge of the pad positioned between the third row of radial stitches and the first row of radial stitches in the upper right portion of the pad, and a fifth row of radial stitches which extends from proximate an edge of the lower right portion of the pad positioned between the third row of radial stitches and the second row of radial stitches and in which the fifth row extends to an opposing edge of the pad positioned between the third row of radial stitches and the second row of radial stitches in the upper left portion of the pad.

21. The ballistic resistant protective garment of claim 2 including a pad cover for covering and enclosing the pad in which the pad cover is substantially the same shape as the pad and is constructed at least in part of water proof and moisture vapor permeable material.

22. The ballistic resistant protective garment of claim 21 including an outer carrier for enclosing and carrying the pad and pad cover and for supporting the covered pad against the body of the wearer.

23. The ballistic resistant protective garment of claim 2 in which the weave for the sheets constructed of lyotropic liquid crystal polymer fiber has a warp to fill ratio of 30 by 30 fibers per inch.

24. The ballistic resistant protective garment of claim 2 in which the plurality of overlying layered sheets of the ballistic resistant pad includes no more than a total of eighteen layered sheets having an areal density not greater than 0.49 lbs/ft$^2$ and having a thickness of no greater than 0.13 inches in which the ballistic resistant pad has a ballistic resistance that prevents projectile penetration according to NIJ Standard 0101.03 for Threat Level IIA.

25. The ballistic resistant protective garment of claim 2 in which the plurality of overlying layered sheets of the ballistic resistant pad includes no more than a total of twenty-two layered sheets having an areal density not greater than 0.60 lbs/ft$^2$ and having a thickness of no greater than 0.16 inches in which the ballistic resistant pad has a ballistic resistance that prevents projectile penetration according to NIJ Standard 0101.03 for Threat Level II.

26. The ballistic resistant protective garment of claim 2 in which the plurality of overlying layered sheets of the ballistic resistant pad includes no more than a total of twenty-eight layered sheets having an areal density not greater than 0.77 lbs/ft$^2$ and having a thickness of no greater than 0.20 inches in which the ballistic resistant pad has a ballistic resistance that prevents projectile penetration according to NIJ Standard 0101.03 for Threat Level III.

27. A ballistic resistant protective garment, comprising:

a ballistic resistant pad; and a plurality of overlying layered sheets of ballistic resistant material forming the pad in which the pad has an areal density not greater than 0.49 lbs/ft$^2$ and having a ballistic resistance that prevents projectile penetration of the ballistic resistant pad according to NIJ Standard 0101.03 for Threat Level IIA.

28. The ballistic resistant protective garment of claim 27 in which the pad has a thickness not greater than 0.13 inches.

29. The ballistic resistant protective garment of claim 27 in which the sheets of ballistic resistant material are formed from a weave of lyotropic liquid crystal polymer fibers.

30. The ballistic resistant protective garment of claim 29 is which the fibers are poly(phenylene-2,6-benzobisoxazole) fibers.

31. The ballistic resistant protective garment of claim 30 in which the ballistic resistant pad has two panels with both panels each having a plurality of layered sheets of woven lyotropic liquid crystal polymer fibers.

32. The ballistic resistant protective garment of claim 31 in which a first panel is positioned at a strike side portion of the pad and has no more than nine sheets of the woven fibers, and a second panel is positioned at a body side portion of the pad and has no more than nine sheets of the woven fibers.

33. The ballistic resistant protective garment of claim 31 including at least six rows of vertical panel securement stitches substantially extending from a top end to a bottom end of the pad securing the panels of the pad together.

34. The ballistic resistant protective garment of claim 33 in which adjacent ones of the rows of vertical panel securement stitches are aligned substantially parallel to one another and are spaced at least one inch apart from each other.

35. The ballistic resistant protective garment of claim 33 in which the rows of vertical panel securement stitches are stitched through each of the overlying layered sheets in both the first panel and second panel of the pad.

36. The ballistic resistant protective garment of claim 33 in which the rows of vertical panel securement stitches are positioned at a central region of the pad, spaced apart from a right edge and a left edge of the pad, proximate a sternum area of a wearer with the pad positioned over the front of a torso of the wearer.

37. The ballistic resistant protective garment of claim 33 in which the first panel has a plurality of rows of stitches and another plurality of rows of stitches which are substantially perpendicular to the rows of stitches to form a pattern of quilt stitches in the first panel, and the second panel has a plurality of rows of stitches and another plurality of rows of stitches which are substantially perpendicular to the rows of stitches of the second panel to form a pattern of box stitches in the second panel.

38. A ballistic resistant protective garment, comprising:

a ballistic resistant pad; and a plurality of overlying layered sheets of ballistic resistant material forming the pad in which the pad has a thickness not greater than 0.13 inches and having a ballistic resistance that prevents projectile penetration of the ballistic resistant pad according to NIJ Standard 0101.03 for Threat Level IIA.

39. The ballistic resistant garment of claim 38 in which the pad has an areal density of not greater than 0.49 lbs/ft$^2$.

40. The ballistic resistant garment of claim 38 in which the sheets of ballistic resistant material are formed from a weave of lyotropic liquid crystal polymer fibers.

41. The ballistic resistant protective garment of claim 40 in which the fibers are poly(p-phenylene-2,6-benzobisoxazole) fibers.

42. The ballistic resistant protective garment of claim 40 in which the ballistic resistant pad has two panels with both panels each having a plurality of layered sheets of woven lyotropic liquid crystal polymer fibers.

43. The ballistic resistant protective garment of claim 42 in which a first panel is positioned at a strike side portion of the pad and has no more than nine sheets of the woven fibers, and a second panel is positioned at a body side portion of the pad and has no more than nine sheets of the woven fibers.

44. The ballistic resistant protective garment of claim 42 including at least six rows of vertical panel securement stitches substantially extending from a top end to a bottom end of the pad securing the panels of the pad together.

45. The ballistic resistant protective garment of claim 44 in which adjacent ones of the rows of vertical panel securement stitches are aligned substantially parallel to one another and are spaced at least one inch apart from each other.

46. The ballistic resistant protective garment of claim 44 in which the rows of vertical panel securement stitches are stitched through each of the overlying layered sheets in both the first panel and second panel of the pad.

47. The ballistic resistant protective garment of claim 44 in which the rows of vertical panel securement stitches are positioned at a central region of the pad, spaced apart from a right edge and a left edge of the pad, proximate a sternum area of a wearer with the pad positioned over the front of a torso of the wearer.

48. The ballistic resistant protective garment of claim 44 in which the first panel has a plurality of rows of stitches and another plurality of rows of stitches which are substantially perpendicular to the rows of stitches to form a pattern of quilt stitches in the first panel, and the second panel has a plurality of rows of stitches and another plurality of rows of stitches which are substantially perpendicular to the rows of stitches of the second panel to form a pattern of box stitches in the second panel.

49. A ballistic resistant protective garment, comprising:

a ballistic resistant pad; and a plurality of overlying layered sheets of ballistic resistant material forming the pad in which the pad has an areal density not greater than 0.60 lbs/ft$^2$ and having a ballistic resistance that prevents projectile penetration of the ballistic resistant pad according to NIJ Standard 0101.03 for Threat Level II.

50. The ballistic resistant protective garment of claim 49 in which the pad has a thickness not greater than 0.16 inches.

51. The ballistic resistant protective garment of claim 49 in which the sheets of ballistic resistant material are formed from a weave of lyotropic liquid crystal polymer fibers.

52. The ballistic resistant protective garment of claim 51 is which the fibers are poly(p-phenylene-2,6-benzobisoxazole) fibers.

53. The ballistic resistant protective garment of claim 51 in which the ballistic resistant pad has two panels with both panels each having a plurality of layered sheets of woven lyotropic liquid crystal polymer fibers.

54. The ballistic resistant protective garment of claim 53 in which a first panel is positioned at a strike side portion of the pad and has no more than eleven sheets of the woven fibers, and a second panel is positioned at a body side portion of the pad and has no more than eleven sheets of the woven fibers.

55. The ballistic resistant protective garment of claim 53 including at least six rows of vertical panel securement stitches substantially extending from a top end to a bottom end of the pad securing the panels of the pad together.

56. The ballistic resistant protective garment of claim 55 in which adjacent ones of the rows of vertical panel securement stitches are aligned substantially parallel to one another and are spaced at least one inch apart from each other.

57. The ballistic resistant protective garment of claim 55 in which the rows of vertical panel securement stitches are stitched through each of the overlying layered sheets in both the first panel and second panel of the pad.

58. The ballistic resistant protective garment of claim 55 in which the rows of vertical panel securement stitches are positioned at a central region of the pad, spaced apart from a right edge and a left edge of the pad, proximate a sternum area of a wearer with the pad positioned over the front of a torso of the wearer.

59. The ballistic resistant protective garment of claim 55 in which the first panel has a plurality of rows of stitches and another plurality of rows of stitches which are substantially perpendicular to the rows of stitches to form a pattern of quilt stitches in the first panel, and the second panel has a plurality of rows of stitches and another plurality of rows of stitches which are substantially perpendicular to the rows of stitches of the second panel to form a pattern of box stitches in the second panel.

60. A ballistic resistant protective garment, comprising:

a ballistic resistant pad; and a plurality of overlying layered sheets of ballistic resistant material forming the pad in which the pad has a thickness not greater than 0.16 inches and having a ballistic resistance that prevents projectile penetration of the ballistic resistant pad according to NIJ Standard 0101.03 for Threat Level II.

61. The ballistic resistant protective garment of claim 60 in which the pad has an areal density of not greater than 0.60 lbs/ft$^2$.

62. The ballistic resistant protective garment of claim 60 in which the sheets of ballistic resistant material are formed from a weave of lyotropic liquid crystal polymer fibers.

63. The ballistic resistant protective garment of claim 62 is which the fibers are poly(p-phenylene-2,6-benzobisoxazole) fibers.

64. The ballistic resistant protective garment of claim 62 in which the ballistic resistant pad has two panels with both panels each having a plurality of layered sheets of woven lyotropic liquid crystal polymer fibers.

65. The ballistic resistant protective garment of claim 64 in which a first panel is positioned at a strike side portion of the pad and has no more than eleven sheets of the woven fibers, and a second panel is positioned at a body side portion of the pad and has no more than eleven sheets of the woven fibers.

66. The ballistic resistant protective garment of claim 64 including at least six rows of vertical panel securement stitches substantially extending from a top end to a bottom end of the pad securing the panels of the pad together.

67. The ballistic resistant protective garment of claim 66 in which adjacent ones of the rows of vertical panel securement stitches are aligned substantially parallel to one another and are spaced at least one inch apart from each other.

68. The ballistic resistant protective garment of claim 66 in which the rows of vertical panel securement stitches are stitched through each of the overlying layered sheets in both the first panel and second panel of the pad.

69. The ballistic resistant protective garment of claim 66 in which the rows of vertical panel securement stitches are positioned at a central region of the pad, spaced apart from a right edge and a left edge of the pad, proximate a sternum area of a wearer with the pad positioned over the front of a torso of the wearer.

70. The ballistic resistant protective garment of claim 66 in which the first panel has a plurality of rows of stitches and another plurality of rows of stitches which are substantially perpendicular to the rows of stitches to form a pattern of quilt stitches in the first panel, and the second panel has a plurality of rows of stitches and another plurality of rows of stitches which are substantially perpendicular to the rows of stitches of the second panel to form a pattern of box stitches in the second panel.

71. A ballistic resistant protective garment, comprising:

a ballistic resistant pad; and a plurality of overlying layered sheets of ballistic resistant material forming the pad in which the pad has an areal density not greater than 0.77 lbs/ft$^2$ and having a ballistic resistance that prevents projectile penetration of the ballistic resistant pad according to NIJ Standard 0101.03 for Threat Level IIIA.

72. The ballistic resistant protective garment of claim 71 in which the pad has a thickness not greater than 0.20 inches.

73. The ballistic resistant protective garment of claim 71 in which the sheets of ballistic resistant material are formed from a weave of lyotropic liquid crystal polymer fibers.

74. The ballistic resistant material of claim 73 is which the fibers are poly(p-phenylene-2,6-benzobisoxazole) fibers.

75. The ballistic resistant protective garment of claim 74 in which the ballistic resistant pad has two panels with both panels each having a plurality of layered sheets of woven lyotropic liquid crystal polymer fibers.

76. The ballistic resistant protective garment of claim 75 in which a first panel is positioned at a strike side portion of the pad and has no more than fourteen sheets of the woven fibers, and a second panel is positioned at a body side portion of the pad and has no more than fourteen sheets of the woven fibers.

77. The ballistic resistant protective garment of claim 76 including at least six rows of vertical panel securement stitches substantially extending from a top end to a bottom end of the pad securing the panels of the pad together.

78. The ballistic resistant protective garment of claim 77 in which adjacent ones of the rows of vertical panel securement stitches are aligned substantially parallel to one another and are spaced at least one inch apart from each other.

79. The ballistic resistant protective garment of claim 77 in which the rows of vertical panel securement stitches are stitched through each of the overlying layered sheets in both the first panel and second panel of the pad.

80. The ballistic resistant protective garment of claim 77 in which the rows of vertical panel securement stitches are positioned at a central region of the pad, spaced apart from a right edge and a left edge of the pad, proximate a sternum area of a wearer with the pad positioned over the front of a torso of the wearer.

81. The ballistic resistant protective garment of 76 in which the first panel has a plurality of rows of stitches and another plurality of rows of stitches which are substantially perpendicular to the rows of stitches to form a pattern of quilt stitches in the first panel, and the second panel has a plurality of rows of stitches and another plurality of rows of stitches which are substantially perpendicular to the rows of stitches of the second panel to form a pattern of box stitches in the second panel.

82. A ballistic resistant protective garment, comprising:

a ballistic resistant pad; and a plurality of overlying layered sheets of ballistic resistant material forming the pad in which the pad has a thickness not greater than 0.20 inches and having a ballistic resistance that prevents projectile penetration of the ballistic resistant pad according to NIJ Standard 0101.03 for Threat Level IIIA.

83. The ballistic resistant protective garment of claim 82 in which the pad has an areal density of not greater than 0.77 $lbs/ft^2$.

84. The ballistic resistant protective garment of claim 82 in which the sheets of ballistic resistant material are formed from a weave of lyotropic liquid crystal polymer fibers.

85. The ballistic resistant protective garment of claim 84 is which the fibers are poly(p-phenylene-2,6-benzobisoxazole) fibers.

86. The ballistic resistant protective garment of claim 84 in which the ballistic resistant pad has two panels with both panels each having a plurality of layered sheets of woven lyotropic liquid crystal polymer fibers.

87. The ballistic resistant protective garment of claim 86 in which a first panel is positioned at a strike side portion of the pad and has no more than fourteen sheets of the woven fibers, and a second panel is positioned at a body side portion of the pad and has no more than fourteen sheets of the woven fibers.

88. The ballistic resistant protective garment of claim 87 including at least six rows of vertical panel securement stitches substantially extending from a top end to a bottom end of the pad securing the panels of the pad together.

89. The ballistic resistant protective garment of claim 88 in which adjacent ones of the rows of vertical panel securement stitches are aligned substantially parallel to one another and are spaced at least one inch apart from each other.

90. The ballistic resistant protective garment of claim 88 in which the rows of vertical panel securement stitches are stitched through each of the overlying layered sheets in both the first panel and second panel of the pad.

91. The ballistic resistant protective garment of claim 88 in which the rows of vertical panel securement stitches are positioned at a central region of the pad, spaced apart from a right edge and a left edge of the pad, proximate a sternum area of a wearer with the pad positioned over the front of a torso of the wearer.

92. The ballistic resistant protective garment of claim 88 in which the first panel has a plurality of rows of stitches and another plurality of rows of stitches which are substantially perpendicular to the rows of stitches to form a pattern of quilt stitches in the first panel, and the second panel has a plurality of rows of stitches and another plurality of rows of stitches which are substantially perpendicular to the rows of stitches of the second panel to form a pattern of box stitches in the second panel.

* * * * *

UNITED STATES PATENT AND TRADEMARK OFFICE

CERTIFICATE OF CORRECTION

PATENT NO. : 6,240,557 B1
DATED : June 5, 2001
INVENTOR(S) : Thomas E. Bachner, Jr.

It is certified that error appears in the above-identified patent and that said Letters Patent is hereby corrected as shown below:

Column 8,
Line 41, change "portion-of" to -- portion of --

Column 15,
Line 26, change "is" to -- in --

Column 16,
Line 16, change "is" to -- in --

Column 17,
Line 4, change "is" to -- in --

Signed and Sealed this

Sixteenth Day of April, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,240,557 B1
DATED : June 5, 2001
INVENTOR(S) : Thomas E. Bachner, Jr.

It is certified that error appears in the above-identified patent and that said Letters Patent is hereby corrected as shown below:

Drawings,

Sheet 3, Figs. 3B and 3C, the lead line for reference numeral 32 should point to or indicate the panel of the ballistic pad strike face, as shown below:

3/4

Fig.3B

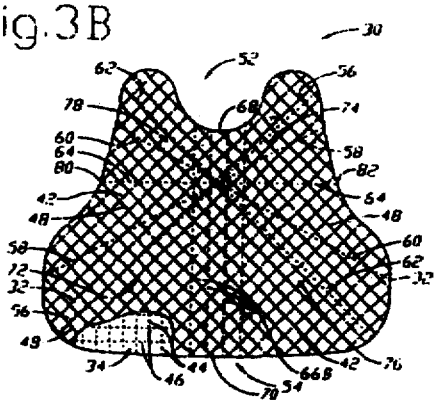

Fig.3C

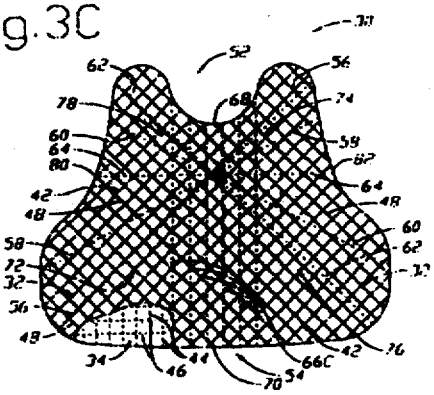

UNITED STATES PATENT AND TRADEMARK OFFICE

CERTIFICATE OF CORRECTION

PATENT NO. : 6,240,557 B1
DATED : June 5, 2001
INVENTOR(S) : Thomas E. Bachner, Jr.

It is certified that error appears in the above-identified patent and that said Letters Patent is hereby corrected as shown below:

Column 8,
Line 43, change "portion-of" to -- portion of --

Column 15,
Line 27, change "is" to -- in --

Column 16,
Line 16, change "is" to -- in --

Column 17,
Line 4, change "is" to -- in --

This certificate supersedes Certificate of Correction issued April 16, 2002

Signed and Sealed this

Nineteenth Day of November, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,240,557 B1 
DATED : June 5, 2001
INVENTOR(S) : Thomas E. Bachner, Jr.

It is certified that error appears in the above-identified patent and that said Letters Patent is hereby corrected as shown below:

Drawings,

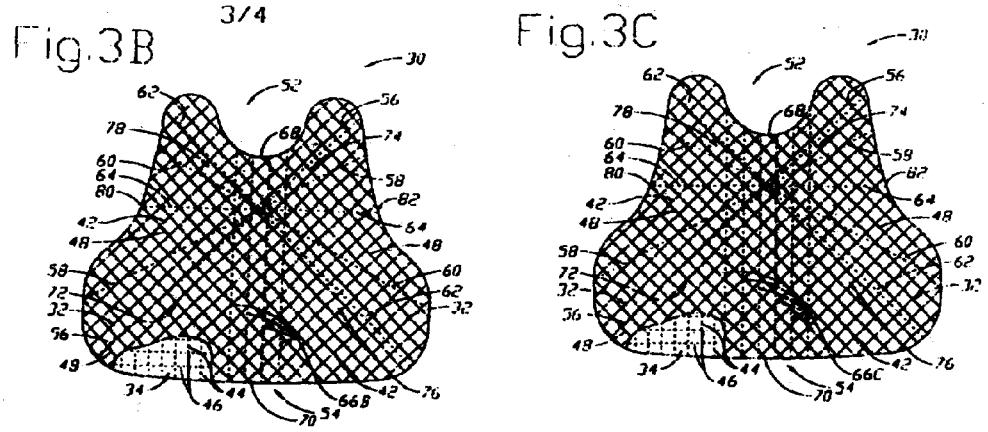

Sheet 3, Figs. 3B and 3C, the lead line for reference numeral 32 should point to or indicate the panel of the ballistic pad strike face, as shown below: